US006962064B1

(12) United States Patent
Hardee et al.

(10) Patent No.: US 6,962,064 B1
(45) Date of Patent: Nov. 8, 2005

(54) KNITTED GLOVE

(75) Inventors: Fred Hardee, Asheville, NC (US); Greg Plemmons, Tinton Falls, NJ (US); Eric Thompson, Clemson, SC (US); San Allen, El Paso, TX (US)

(73) Assignee: Ansell Healthcare Products LLC, Red Bank, NJ (US)

( * ) Notice: Subject to any disclaimer, the term of this patent is extended or adjusted under 35 U.S.C. 154(b) by 0 days.

(21) Appl. No.: 10/892,763

(22) Filed: Jul. 16, 2004

(51) Int. Cl.[7] ..... D04B 9/58
(52) U.S. Cl. ..... 66/174; 2/159
(58) Field of Search ..... 2/163, 167, 16, 2/159, 161.1, 161.6; 66/174, 202, 158, 159, 66/161.1, 161.6, 167

(56) References Cited

U.S. PATENT DOCUMENTS 5,187,815 A * 2/1993 Stern et al. ..... 2/16
5,231,700 A * 8/1993 Cutshall ..... 2/161.7
5,564,127 A * 10/1996 Manne ..... 2/161.7
6,044,493 A 4/2000 Post
6,155,084 A * 12/2000 Andrews et al. ..... 66/174
6,581,366 B1 6/2003 Andrews
6,766,635 B2 7/2004 Andrews
6,782,720 B2 * 8/2004 Vero et al. ..... 66/171
6,790,122 B2 9/2004 Mitchell et al.
6,823,699 B1 * 11/2004 Vero et al. ..... 66/171

* cited by examiner

*Primary Examiner*—Danny Worrell
(74) *Attorney, Agent, or Firm*—Gardner Carton & Douglas LLP

(57) ABSTRACT

A knitted glove made by creating eight glove components having at least fifteen separate knitted sections altogether on a knitting machine. The glove includes five finger components made from at least two separately knitted sections for each finger component, two palm components, each of which is made from at least two separately knitted sections, and a wrist component made from at least one knitted section.

24 Claims, 2 Drawing Sheets

KNITTED GLOVE

FIELD OF THE INVENTION

The present invention relates to knitted gloves. More specifically, the invention relates to knitted gloves, knitted glove liners and novel methods of making them.

BACKGROUND OF THE INVENTION

Knitted gloves are commonly used in handling and light assembly conditions. Knitted gloves used for these purposes are currently made using knitting machines that knit the gloves using eight basic components to comprise the glove. These eight components include one component each for the five fingers, two components for the palm including a upper section and a lower section, and one component for the wrist area. Conventional knitting processes use a knitting machine to knit each of these areas in a particular sequence, generally one finger at a time, beginning with the pinky finger and continuing on through the ring finger and middle finger to the forefinger. The knitting machine then knits the upper section of the palm, followed by the thumb and the lower section of the palm. Finally, the knitting machine knits the wrist component to the desired length.

The knitting stitches used at the fingertips are generally tighter than the stitches used elsewhere in the glove to improve the strength of the glove in this area where more pressure is likely to be applied. Depending on the needles used to knit the gloves, a certain number of courses are used to create each of the eight components of the glove. The finer the gauge of needle used, the higher the number of courses for each component to create the same size finished glove. While this standardization in needle size and number of courses permits the manufacturing of a glove or liner with a standard shape, that shape does not accommodate variations in size and shape of individual fingers and hands.

Standard shape gloves or liners created by the current processes bring with them several disadvantages. First, the fit across finger knuckles and the center of the palm is tight, reducing glove or liner flexibility and ultimately reducing hand dexterity. Second, the standard gloves or liners bag or gap in areas where the hand normally tapers, like the lower palm and wrist area. This bagginess or gapping results in excess fabric which can bunch and catch on protruding objects. Additionally, excess fabric at the lower palm created by the standard glove or liner shape causes an irregular foam line on those liners that are dipped in latex. Finally, the excess fabric at the lower palm of the standard glove or liner causes a high scrap rate in printing information on the gloves or liners.

In an attempt to solve these problems, knit gloves or liners can be made of a larger than standard size to shrink them to achieve a better fit. These larger gloves are reduced in size by tumbling them in heat or using a laundry process. These processes as used on the larger gloves, however, may produce gloves that have improved fit across the knuckles, but do not address the excess fabric in areas where the hand normally tapers, like the lower palm and wrist. Additionally, tumbling or a laundry process would require an additional manufacturing step as well as additional labor, both of which would increase the cost of the finished product. A standard tumbling process, using constant heat and time, would also fail to create the desired gloves and liners because of differences in heat sensitivity to the fibers used to knit the various gloves and liners. Further, these types of post-knitting processes would require additional development and manufacturing time to determine appropriate time and heat combinations to optimize glove or liner production. A glove that could be made to fit the contours of a human hand better to improve grip and that would not require post-knitting processing would therefore be an important improvement in the art.

BRIEF SUMMARY OF THE INVENTION

The present invention is directed toward knitted gloves and liners and a method of making these knitted gloves and liners. The invention relates to the fit of knitted gloves or liners on a human hand. Specifically, the number of stitches used in making the glove is altered in more than one component within the standard eight major glove components. These alterations help conform the glove or liner to better fit human hands. The alterations permit manufacturing of gloves or liners with nearly perfect fit to the hand because of their tapered fingertips, expanded knuckles, tapered palm areas and expanded cuff width.

In one embodiment, one or more of the finger components of the glove is divided into two or more sections, the palm component is divided into two or more sections and the wrist component is made up of one or more sections, where each section is knitted using a different stitch setup and number of courses. In another embodiment, each of the finger components of the glove are divided into three sections, and the palm of the glove is divided into three sections, where each section is knitted using a different stitch setup and number of courses. In another embodiment, the palm of the glove is divided into four sections, where each section is knitted using a different stitch setup and number of courses.

The invention also includes a method for manufacturing gloves and liners using variable stitches and numbers of courses in each of the sections within each of the eight major glove components to create a better fitting glove. These and other advantages of the invention will be apparent from the description of the invention provided herein.

DETAILED DESCRIPTION OF THE INVENTION

Figure 1:
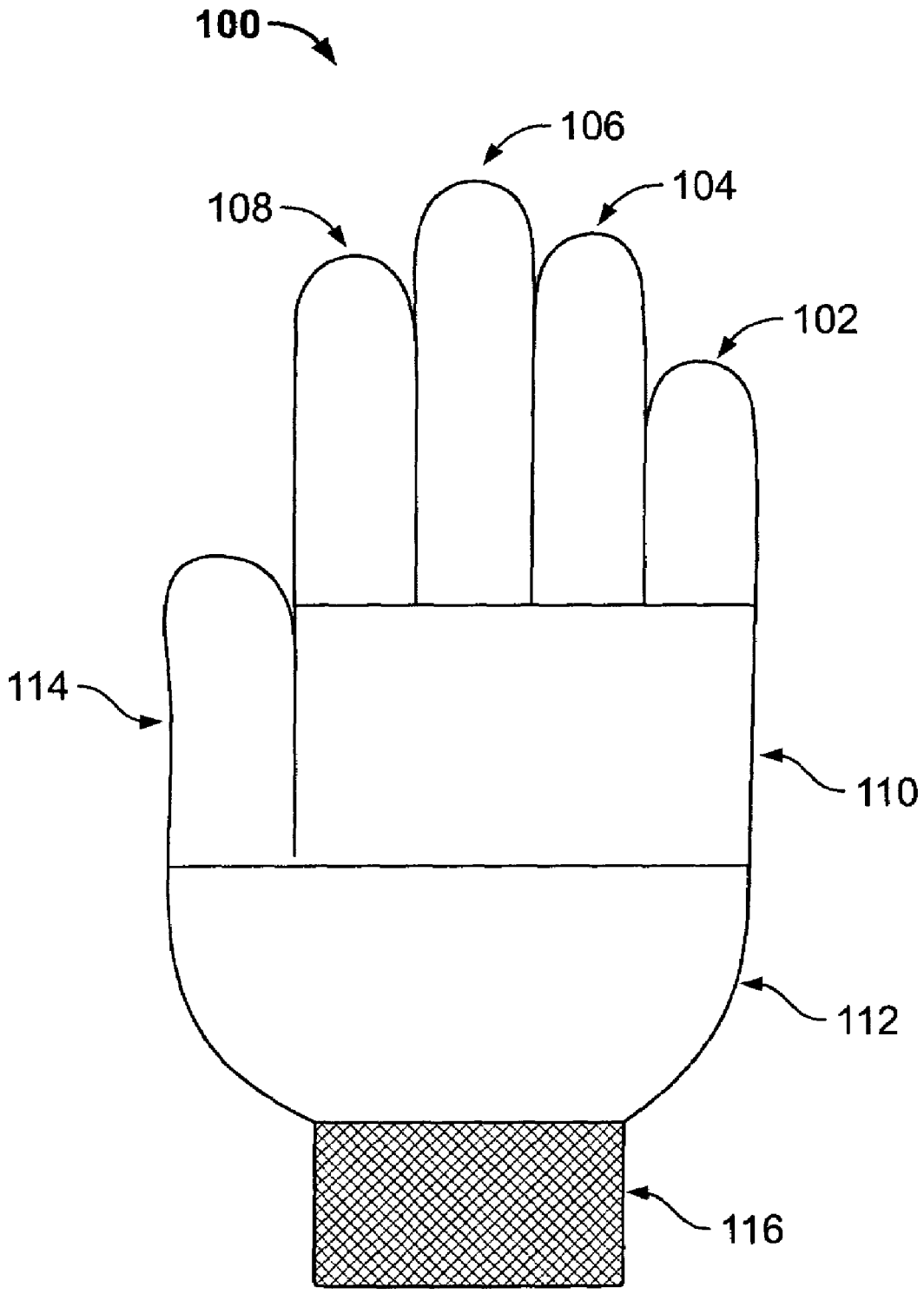
FIG. 1 shows a glove knitted using a standard number of courses and needles to create the standard eight components.

The prior art, as shown in FIG. 1, is a glove 100, having eight major glove components. These components include a pinky finger component 102, a ring finger component 104, a middle finger component 106, a forefinger component 108, an upper palm component 110, a lower palm component 112, a thumb component 114 and a wrist component 116. As can be seen in FIG. 1, the shape of the glove 100 fingers does not taper, nor does the wrist component 116 taper to prevent bagginess and gapping at the wrist. Additionally, the fingers of the glove 100 do not taper near the fingertips.

Figure 2:
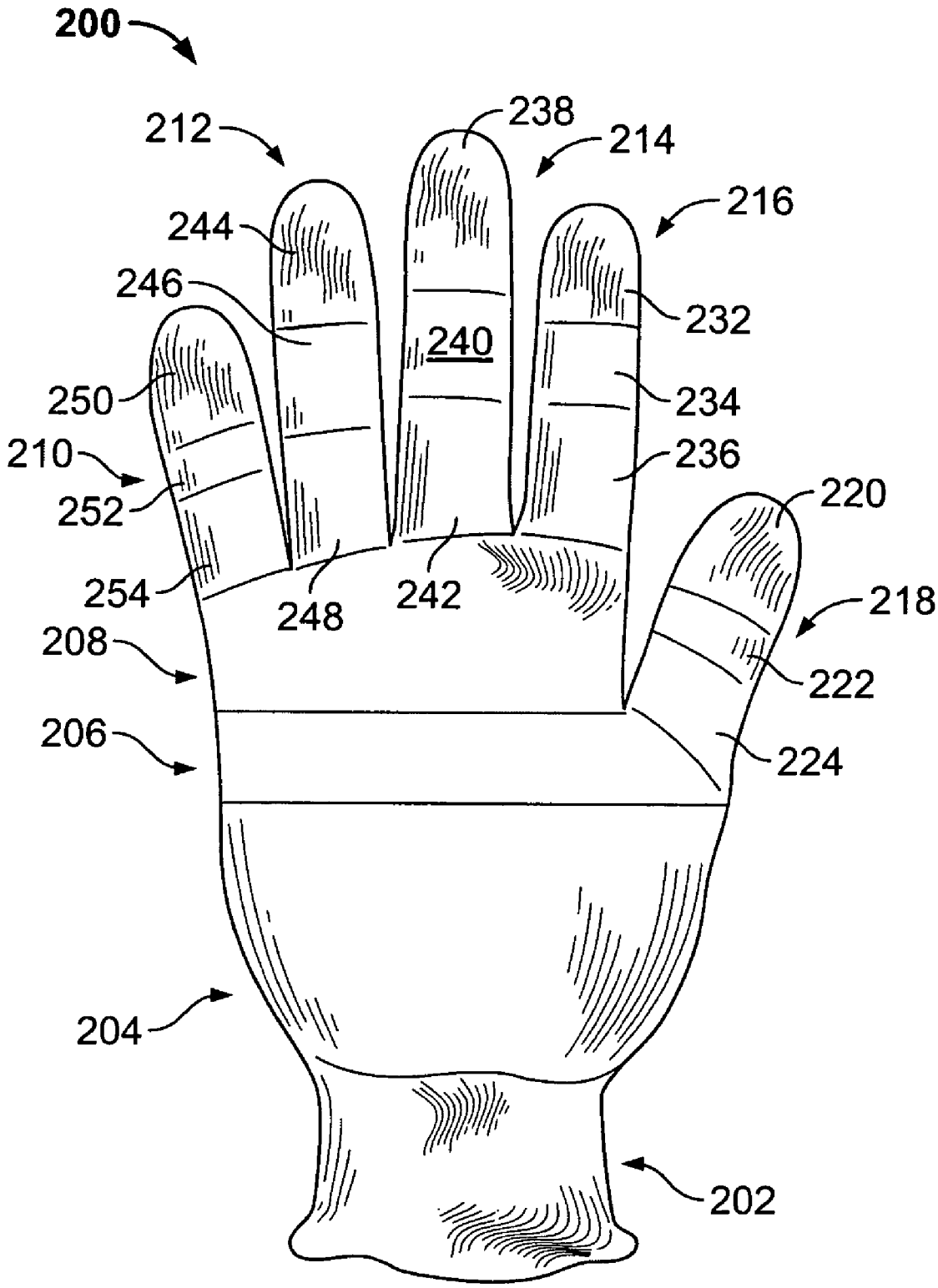
FIG. 2 shows the glove of the present invention.

Existing knitting machines can be programmed to accommodate a large number of changes in stitch dimensions than the dimensions used in a standard eight component glove 100. Stitch dimensions can be used to "customize" gloves and liners manufactured in sizes 6, 7, 8, 9, and 10. They can also be used to develop specifications for finger length and width, palm length and width, and overall glove or liner length and width. FIG. 2 shows the glove 200 of the present invention. This glove 200 includes nineteen total sections of the glove, including three sections for each of the finger components 210, 212, 214, 216 and 218 of the glove, three palm sections 204, 206 and 208 and one wrist section 202. Each of the fingers 210, 212, 214, 216 and 218 is knit according to three separate instructions for the knitting machine to create these three distinct areas designed to conform to the shape of fingers. These three sections are shown in FIG. 2 as sections 250, 252, and 254 for the pinky finger 210; sections 244, 246, and 248 for the ring finger 212; sections 238, 240 and 242 for the middle finger 214; sections 232, 234, and 236 for the forefinger 216; and sections 220, 222, and 224 for the thumb 218.

The glove 200 of this invention can be knit on a knitting machine and requires programming of the machine for each of the nineteen sections. For example, the glove 200 can be made according to the specifications provided in Table 1.

TABLE 1

| | STITCH SETUP | COURSES | SECTION IN FIG. 2 | | STITCH SETUP | COURSES | SECTION IN FIG. 2 |
|---|---|---|---|---|---|---|---|
| 1 | 37–39 | 1–22 | 250 | 2 | 37–39 | 1–32 | 244 |
| | 39 | 23–58 | 252 | | 39 | 33–100 | 246 |
| | 39–37 | 59–88 | 254 | | 39–37 | 73–116 | 248 |
| 3 | 37–39 | 1–32 | 238 | 4 | 37–39 | 1–32 | 232 |
| | 39 | 33–72 | 240 | | 39 | 33–72 | 234 |
| | 39–37 | 73–126 | 242 | | 39–37 | 73–116 | 236 |
| 5 | 37 | 1–56 | 208 | 6 | 37–39 | 1–32 | 220 |
| | | | | | 39 | 33–69 | 222 |
| | | | | | 39–37 | 65–100 | 224 |
| 7 | 37 | 1–20 | 206 | 8 | 37 | 1–72 | 202 |
| | 36–22 | 21–70 | 204 | | | | |

The specifications in Table 1 can be used on a New SFG knitting machine available from Shima Seiki Mfg., Ltd. based in Wakayama, Japan to create a size 9 glove. The information for the stitch setup and the number of courses is entered into the knitting machine's operation system using a keypad and LED display. Adjustments may be made to the specifications in Table 1 to create gloves of different sizes. The gloves may be knit from different compositions of yarn, including cotton, nylon fibers, water-soluble fibers such as polyvinyl alcohol, or other fibers that may be used on a knitting machine such as polyester, or high strength synthetic-fibers such as aramid, polyethylene and liquid crystal polymer. The yarns used to knit the gloves may be spun yarns, textured filament yarns, or multi-component composite yarns.

The knitted variable stitch dimensions in the glove 200 allow the alteration of stitch size within a larger number of finger and palm sections than would be found in a standard glove 100. This increased number of sections benefits the glove by improving the degree to which it conforms to the shape of the hand, creating a better fit. In turn, this better fit provides increased dexterity and grip as well as increased long-term comfort in wearing the glove. In the present invention, stitch dimensions can be decreased in areas such as knuckles which would require greater glove flexibility as fingers move.

Knitted stitch dimensions can be used to eliminate additional manufacturing steps that would be required in, for example, the use of heat or water to shrink gloves or liners to fit a particular hand size. This saves both money and time in the manufacturing process and does not require unique times, temperatures, or pressures. It also produces a more consistent product than one relying on difficult-to-control steps such as heat or tumbling.

A small study has been conducted to compare glove flexibility and resulting hand dexterity of standard shape gloves as compared to gloves of this invention. Subjects in the study assembled eight sets of five different nut and screw sizes while wearing the standard glove and while wearing the knitted variable stitch glove of this invention. Each subject in the study showed a decrease in the time it took to assemble the set of nuts and screws when wearing the gloves of this invention. In the study, decreases in time ranged from 13.9% to 20.3% less time for participants to assemble the sets of screws and nuts wearing the gloves of the present invention than while wearing standard knitted gloves. This study shows that the glove of this invention improved the fit of the knitted gloves such that it increased dexterity and grip over the standard glove.

The knitted gloves of this invention, once finished, may also be coated either on the outside or inside with a coating such as natural rubber latex or synthetic rubber latex, as well as other elastomeric polymer coatings. The coating may be applied by dipping the knitted glove of this invention into the coating material or by spraying the coating onto the glove. Coating the knitted gloves of this invention can improve the grip of the glove in handling dry and oily items when the coating is on the outside of the glove. The addition of a coating to the knitted layer can also improve the quality of the glove as an insulator.

Although only a few exemplary embodiments of the present invention have been described in detail above, those skilled in the art will readily appreciate that many modifications are possible in the exemplary embodiments without materially departing from the novel teachings and advantages of this invention. For example, the number of sections of the glove may be increased or decreased to adjust the fit of the glove without departing from the spirit of the present invention. Accordingly, all such modifications are intended to be included within the scope of this invention as defined in the following claims.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A knitted glove comprising eight glove components comprising:

a plurality of finger components, each of which has at least two separate knitted sections;

two palm components, each of which has at least two separate knitted sections;

and a wrist component having at least one knitted section;

wherein each of the at least fifteen knitted sections comprises a different stitch setup producing variable stitch dimensions and number of courses whereupon the glove has an overall shape that accommodates variations in size and shape of individual fingers and hands.

2. The knitted glove of claim 1 wherein each of the plurality of finger components is comprised of two separate knitted sections.

3. The knitted glove of claim 1 wherein each of the plurality of finger components is comprised of three separate knitted sections.

4. The knitted glove of claim 1 wherein each of the plurality of finger components is comprised of four separate knitted sections.

5. The knitted glove of claim 1 wherein the plurality of finger components is five finger components.

6. The knitted glove of claim 1 wherein the plurality of finger components is four finger components and a thumb component.

7. The knitted glove of claim 1 wherein the palm component is comprised of three separate knitted sections.

8. The knitted glove of claim 1 wherein the palm component is comprised of four separate knitted sections.

9. The knitted glove of claim 1 wherein the palm component is comprised of five separate knitted sections.

10. The knitted glove of claim 1 wherein the wrist component is comprised of two separate knitted sections.

11. The knitted glove of claim 1 wherein the wrist component is comprised of three separate knitted sections.

12. The glove of claim 1 wherein the glove is knitted from a natural fiber.

13. The glove of claim 12 wherein the natural fiber is cotton.

14. The glove of claim 1 wherein the glove is knitted from a synthetic fiber.

15. The glove of claim 14 wherein the synthetic fiber is selected from the group consisting of nylon, polyvinyl alcohol, aramid, polyethylene, and liquid crystal polymer.

16. The glove of claim 1 wherein the knitted glove is coated with an elastomeric polymer material.

17. The glove of claim 16 where the elastomeric polymer material is selected from the group consisting of natural rubber latex and synthetic rubber latex.

18. A method of making a knitted glove, the method comprising programming a knitting machine to knit a glove comprising eight glove components comprising:

a plurality of finger components, each of which has at least two separate knitted sections;

two palm components, each of which has at least two separate knitted sections;

and a wrist component having at least one knitted section;

wherein each of the at least fifteen knitted sections comprises a different stitch setup producing variable stitch dimensions and number of courses, whereupon the glove has an overall shape that accommodates variations in size and shape of individual fingers and hands.

19. The method of claim 18 further comprising coating the glove with an elastomeric polymer material.

20. The method of claim 19 wherein the elastomeric polymer material is chosen from a group consisting of natural rubber latex and synthetic rubber latex.

21. The method of claim 18 wherein the glove is knitted from a natural fiber.

22. The method of claim 21 wherein the natural fiber is cotton fiber.

23. The method of claim 18 wherein the glove is knitted from a synthetic fiber.

24. The method of claim 23 wherein the synthetic fiber is selected from the group consisting of nylon, polyvinyl alcohol, aramid, polyethylene, and liquid crystal polymer.

* * * * *